US005515569A

United States Patent [19]

Montabaur et al.

[11] Patent Number: 5,515,569

[45] Date of Patent: May 14, 1996

[54] HANDBRUSH ESPECIALLY FOR CLEANING CARPETS AND UPHOLSTERY

[75] Inventors: Werner Montabaur, Königswinter; Detlef Thomas, Köln, both of Germany

[73] Assignee: Monti-Werkzeuge GmbH, Bonn, Germany

[21] Appl. No.: 286,881

[22] Filed: Aug. 5, 1994

[30] Foreign Application Priority Data

Aug. 10, 1993 [DE] Germany ..... 9311928 U

[51] Int. Cl.[6] ..... A46B 3/00; A46B 5/02; A46B 9/02

[52] U.S. Cl. ..... 15/160; 15/143.1; 15/176.1; 15/186; 15/200

[58] Field of Search ..... 15/159.1, 160, 15/171, 172, 176.1–176.6, 186–188, 197, 200–202, 143.1

[56] References Cited

U.S. PATENT DOCUMENTS

| | | | |
|---|---|---|---|
| 671,839 | 4/1901 | Rosenberg | 15/160 |
| 753,970 | 3/1904 | Foster | 15/186 |
| 980,161 | 12/1910 | Knoller | 15/176.1 |
| 1,327,807 | 1/1920 | Burleigh | 15/176.1 |
| 1,337,173 | 4/1920 | White | 15/176.1 |
| 1,378,530 | 5/1921 | Evslin | 15/176.3 |
| 1,494,448 | 5/1924 | Sookne | 15/188 |
| 1,777,516 | 10/1930 | Castle | 15/160 |
| 2,054,233 | 9/1936 | Young | 15/188 |
| 2,254,365 | 9/1941 | Griffith et al. | 15/172 |
| 2,418,344 | 4/1947 | Goldberg | 15/187 |
| 2,482,928 | 9/1949 | Neff et al. | 15/186 |
| 2,864,111 | 12/1958 | Rotceig | 15/201 |
| 3,843,990 | 10/1974 | Lardenois | 15/186 |
| 4,114,222 | 9/1978 | Serediuk | 15/201 |
| 5,355,546 | 10/1994 | Scheier et al. | 15/201 |

FOREIGN PATENT DOCUMENTS

| | | | |
|---|---|---|---|
| 1098200 | 3/1955 | France | 15/176.1 |
| 283892 | 4/1915 | Germany | 15/201 |
| 17492 | of 1914 | United Kingdom | 15/200 |
| 804331 | 11/1958 | United Kingdom | 15/187 |
| 2118029 | 10/1983 | United Kingdom | 15/187 |

*Primary Examiner*—Mark Spisich
*Attorney, Agent, or Firm*—Herbert Dubno

[57] ABSTRACT

A handbrush for upholstery and carpets can have its brush body formed with at least one elastically bendable bristle band colinear with a handle and provided with bristles which can project forwardly on the band.

16 Claims, 5 Drawing Sheets

HANDBRUSH ESPECIALLY FOR CLEANING CARPETS AND UPHOLSTERY

FIELD OF THE INVENTION

The present invention relates to a handbrush, especially for the cleaning of carpets, automobile upholstery, furniture upholstery or the like and, more particularly, to a handbrush having a brush body provided with bristles and a grip connected with the brush body.

BACKGROUND OF THE INVENTION

Handbrushes of the aforedescribed type are available in various configurations and for a variety of purposes. Usually the brush body is provided only along one side of with bristles and thus may comprise a bristle bed from which bristles of hair, synthetic-resin filaments, or steel wire can project and in which such bristles are anchored. Such a handbrush can be utilized, for example, for the cleaning of carpets, automobile upholstery and cushioned furniture generally. The cleaning of such items with earlier brushes was, however, somewhat limited since, although a large area may be provided with the bristles, they are so oriented or so attached to the bed as not to effectively clean readily accessible large area surfaces.

The cleaning of corner areas and angular parts poses significant problems. It is not always possible to effectively remove tracked-in soil, hair or other materials which are difficult to loosen or pick up, especially at limitedly accessible regions.

OBJECTS OF THE INVENTION

It is therefore an object of the present invention to provide a handbrush which has improved cleaning power, i.e. is sufficiently stiff to enable tracked-in soil, hair and like cleaning-resistant contaminants to be removed readily from carpets and upholstery, and which is also particularly effective in regions which have been difficult to reach with conventional brushes.

Another object of the invention is to provide an improved handbrush for the cleaning of carpets, automobile upholstery and cushioned or domestic upholstery, whereby drawbacks of earlier devices are avoided.

Another object of the invention is to provide a readily fabricated, easily handled and relatively inexpensive handbrush which is particularly effective for the lifting or straightening of the pile and is particularly useful for carpets and upholstery which may have regions of limited accessibility to brushes.

SUMMARY OF THE INVENTION

These objects and others which will become apparent hereinafter are attained in accordance with the invention in a handbrush for the purposes described in which the brush body has at least one bend-elastic bristle band provided on one or both sides with bristles which project from this band and wherein the bristle band extends colinearly with the handgrip, i.e. in line therewith. According to a feature of the invention, the brush body has two bend-elastic bristle bands which can have juxtaposed surfaces lying against one another and which can have bristles projecting away from the opposite surfaces of the bands. In this case, the two bristle bands can be adhesively bonded together in the regions of their mutually contacting surfaces and the thus bonded assembly can be anchored in the handgrip.

It is also possible to anchor the two bristle bands together at their free ends remote from the hand grip by means of at least one clamp while the other ends of the bands are anchored in the hand grip.

According to another aspect of the invention, the brush body, which is comprised of two bend-elastic bristle bands and a bend-elastic bending plate between them, is anchored in the handle by one end of the assembly.

For this purpose, the plate can have, at its end remote from the handle, respective U-shaped pockets or channels for the free ends of the bristle bands while at its opposite end anchored in the handle the plate can have a T-shaped configuration received in a complementary recess in the handle.

According to still another aspect of the invention, the bend-elastic bristle band can form a loop with outwardly extending bristles as an extension of the handle.

The brush of the invention allows a wide area cleaning of carpets, automobile upholstery or other cushioned objects. It is especially effective in the cleaning of corner and angular regions which might not be accessible to other kinds of brushes. The brush of the invention allows not only a sweeping action with the handle parallel to the surface but also a paint-brush action to be used. The bend-elastic bristle bands adjust readily to the contours of the surface and nevertheless have a sufficient stiffness to allow hair, lint and other difficult contaminants to be dealt with satisfactorily. Especially when the handbrush of the invention is used to clean carpets, automobile upholstery and other cushions, the brush can serve for the straightening and lifting of the pile so that even highly depressed regions can be repaired readily.

According to another feature of the invention, the unit consisting of two bristle bands and an anchoring plate to which the two bristle bands are adhesively bonded can be detachably or permanently mounted in the handle.

When two bristle bands are used, these should be coextensive with one another, i.e. have their edges flush with one another and, when an anchoring plate is provided between them, at least the longitudinal edges of the bristle bands should be flush with the longitudinal edges of the plate.

The handle itself can be composed of two shell halves which can be thermally bonded (welded) together to permanently engage the brush body or can be assembled together so as to be detachable and thereby allow replacement of the brush body.

The bristle band can be a thick or multilayer band of a bend-elastic material such as a rubber, plastic fabric or a combination thereof to provide sufficient bendability and elasticity.

The bristles are made preferably of plastic or metal and particularly can be steel bristles. The steel bristles can have a U-shaped configuration with the bight or base of the U anchored in the band. While the bristles can be orthogonal to the band, they preferably include an angle with the band by which they project forwardly away from the handle. The ends of the bristles are cropped so that, even though the bristles extend at an acute angle to the band, their end surfaces extend parallel thereto.

Thus, the handbrush of the invention can comprise:

an elongated handle; and means forming a brush body affixed to an end of the handle and extending from the end generally in line with the handle, the brush body comprising at least one elongated bendable and elastic band provided with bristles projecting from the band at at least one side thereof.

Alternatively, the handbrush can comprise:

an elongated handle;

means forming a brush body affixed to an end of the handle and extending from the end generally in line with the handle; and at least one elongated bendable and elastic band provided with bristles projecting outwardly from the band and in the form of a loop around the brush body.

BRIEF DESCRIPTION OF THE DRAWING

The above and other objects, features, and advantages will become more readily apparent from the following description, reference being made to the accompanying drawing in which.

SUMMARY OF THE INVENTION

Figure 1:
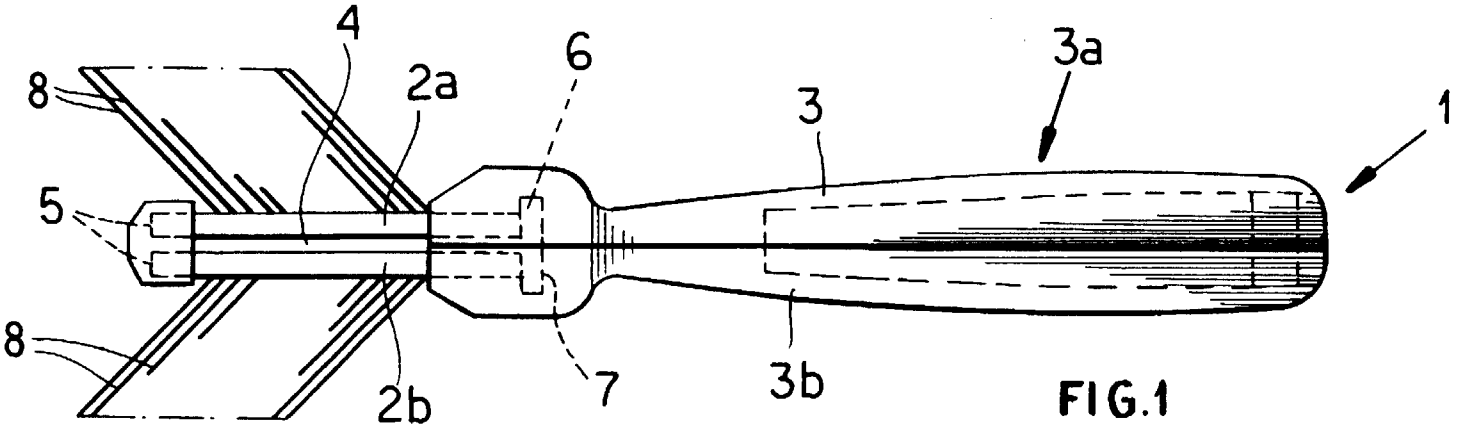
FIG. 1 is a diagrammatic elevational view of a hand brush formed with two bristle bands and an anchoring plate according to the invention.
Figure 2:
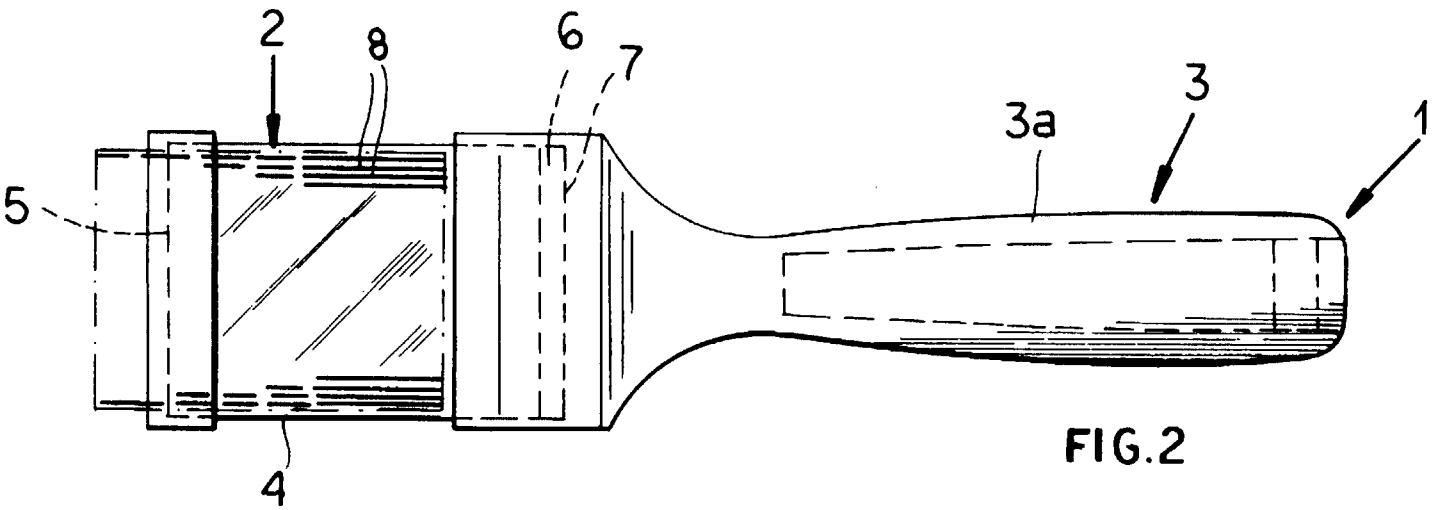
FIG. 2 is a plan view of the handbrush of FIG. 1.
Figure 3:
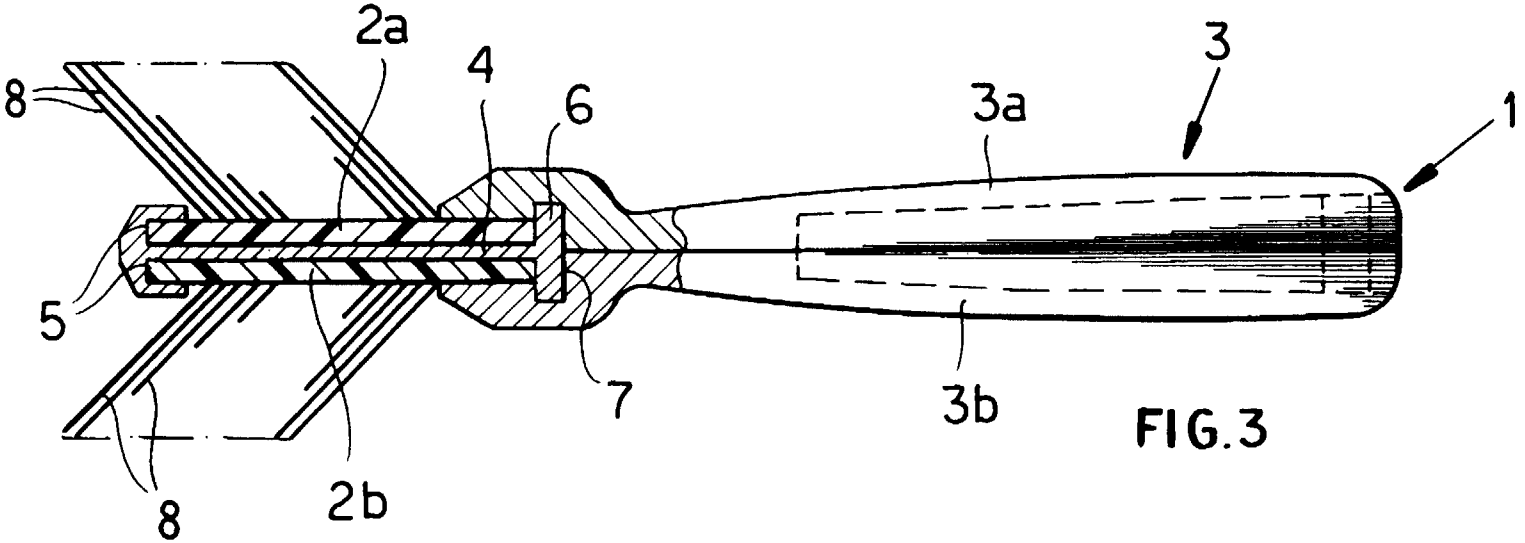
FIG. 3 is a partial longitudinal section through the handbrush of FIG. 1.
Figure 4:
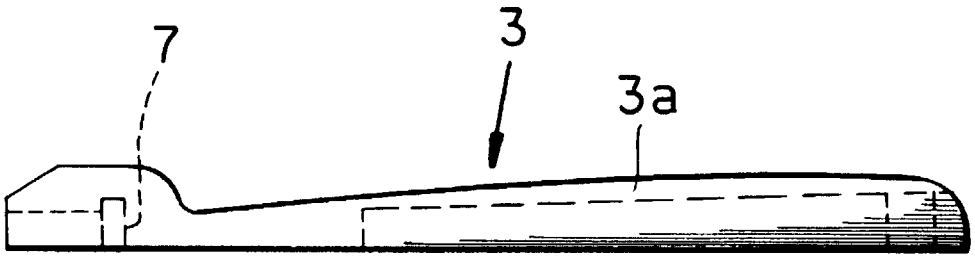
FIG. 4 is a longitudinal section through a handle half for the embodiment of FIG. 1.
Figure 5:
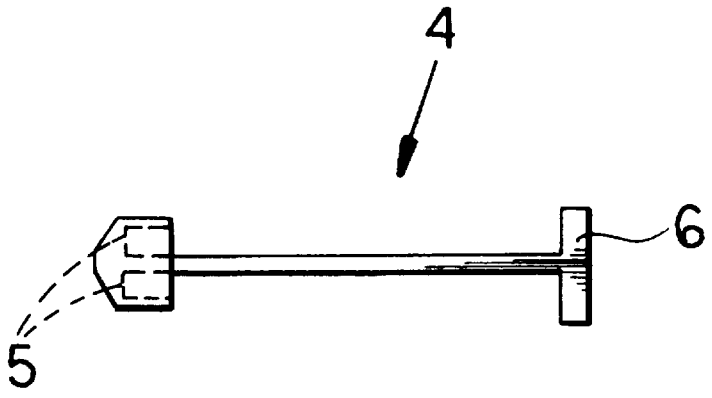
FIG. 5 is a side elevational view of the anchoring plate used in the embodiment of FIG. 1.
Figure 6:
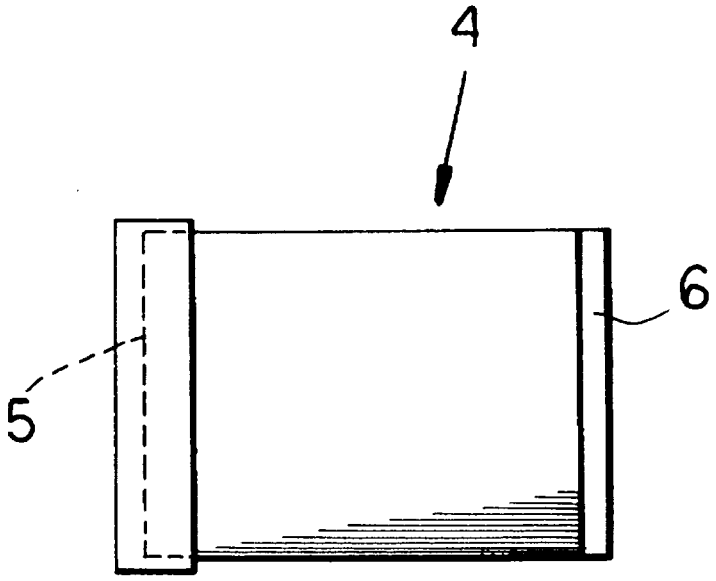
FIG. 6 is a plan view of the anchoring plate.

In the drawing, we have shown a handbrush 1 for the cleaning especially of carpets, automobile cushions, furniture cushions and in general, upholstery, which comprises a bristle body 2 and a handgrip 3.

The bristle body 2 comprises two elastically bendable bands 2*a* and 2*b* (FIG. 1) and an anchoring plate 4 disposed between them, the anchoring plate 4 also being bendable but elastic.

At a front end, the anchoring plate 4 is formed with pockets defining U-section channels 5 accommodating the free ends of the bands 2*a* and 2*b*.

At the opposite ends the plate 4 has a T-shaped formation 6. The unit composed of the two bands 2*a* and 2*b* and the anchoring plate 4 is engaged at the T-shaped formation in a T-shaped anchoring recess 7 of the handle 3.

Figure 10:
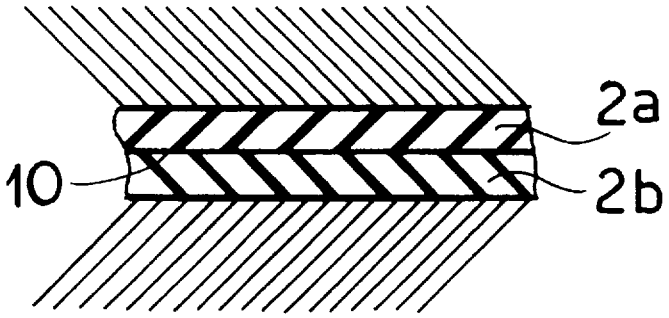
FIG. 10 is a cross sectional view showing two bristle bands adhesively bonded together back to back.

As can be seen from FIG. 10, the two bands 2*a* and 2*b* can be adhesively bonded together at a juxtaposed surface represented by the adhesive interface 10 in FIG. 10. Alternatively, the bands 2*a* and 2*b* can be adhesively bonded to the anchoring plate 4 and can be coextensive with longitudinal edges flush therewith.

The handgrip 3 can be comprised of two half shells 3*a* and 3*b* of synthetic resin which can be welded together to form the handle and can be thermally welded as well to the bands 2*a* and 2*b* and to the anchoring plate 4. As can be seen from FIG. 7, the handgrip halves 3*a* and 3*b* can, alternatively, be interconnected releasably, e.g. by the screw 11.

Figure 7:
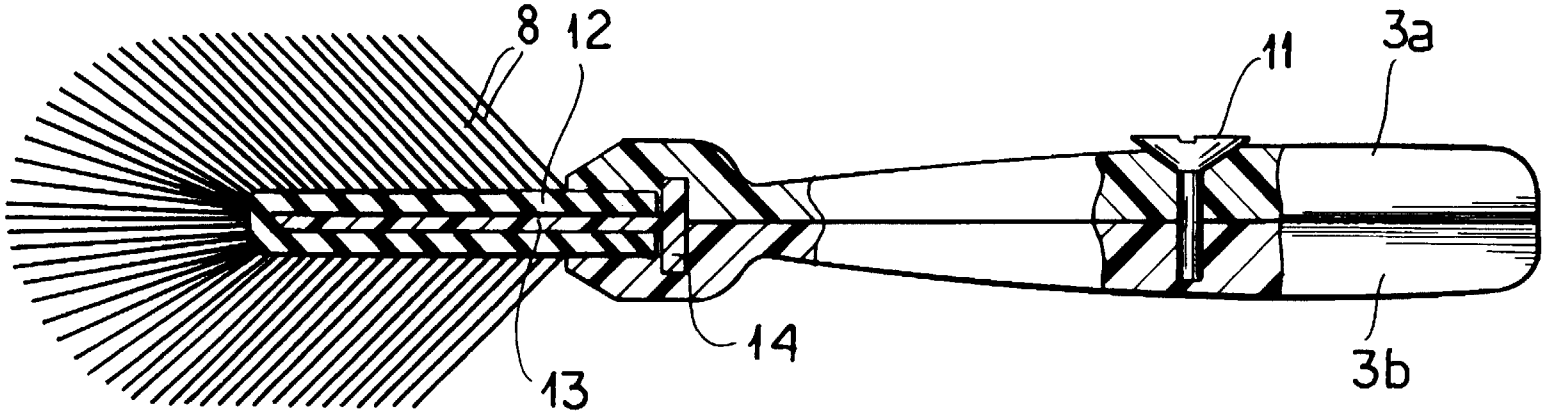
FIG. 7 is a partial cross sectional view through an embodiment in which the bristle band is in the form of a loop.

The bristle bands 2*a* and 2*b* can be provided with bristles 8 projecting forwardly at an angle to the respective band. In the embodiment of FIG. 7, the bristles 8 are provided on body sides of a band 12 which forms a loop around an end of an anchoring plate 13 having a T-shaped formation 14 engaged between the two halves 3*a* and 3*b* of the handle.

Figure 8:
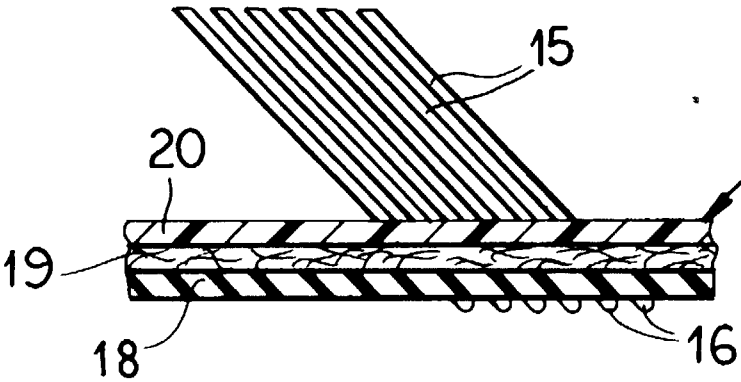
FIG. 8 is a detailed cross section showing a composite bristle band with steel wires thereon.

In FIG. 8 the steel bristles 15 are of a U-shaped configuration and have bights or bases 16 engaged in a band 17 which can be a composite of a rubber layer 18, a fabric 19 and a plastic layer 20.

Figure 9:
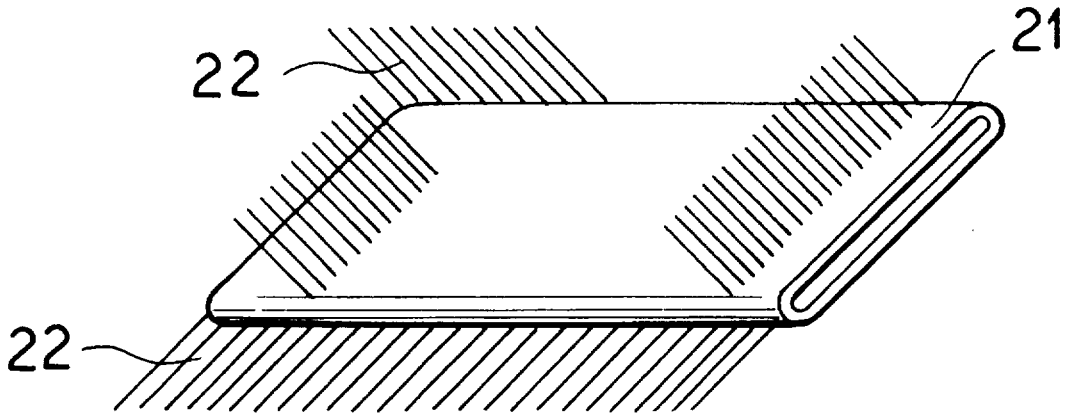
FIG. 9 is a diagrammatic perspective view illustrating another embodiment of a bristle band.

Another loop configuration has been shown in FIG. 9 wherein the band 21 can receive the anchoring plate and has bristles 22 on opposite sides thereof.

We claim:

1. A handbrush for cleaning of carpets, automobile upholstery and household upholstery, comprising:

an elongated handle; and means forming a brush body affixed to an end of said handle and extending from said end generally in line with said handle, said brush body further comprising two elongated bendable and elastic bands, each of said bands being provided with respective arrays of bristles projecting from the respective band at one side thereof, said bands having mutually contacting surfaces adhesively bonded together.

2. The handbrush defined in claim 1 wherein said bands are anchored in said handle.

3. The handbrush defined in claim 1, further comprising means for releasably mounting said brush body in said handle.

4. The handbrush defined in claim 1, further comprising means for permanently mounting said brush body on said handle.

5. The handbrush defined in claim 1 wherein said handle comprises two half shells engaging said body between them and welded together and to said body.

6. The handbrush defined in claim 1 wherein said bands are multilayer webs composed of a material selected from the group consisting of rubber, synthetic resin and fabric.

7. The handbrush defined in claim 1 wherein said bristles are composed of a material selected from the group consisting of synthetic resin and metal.

8. The handbrush defined in claim 7 wherein said bristles are composed of steel.

9. The handbrush defined in claim 8 wherein said bristles are generally U-shaped with bights anchored in the respective band.

10. A handbrush for cleaning of carpets, automobile upholstery and household upholstery, comprising:

an elongated handle; and means forming a brush body affixed to an end of said handle and extending from said end generally in line with said handle, said brush body further comprising two elongated bendable and elastic bands, each of said bands being provided with respective arrays of bristles projecting from the respective band at one side thereof, a bendable and elastic anchoring plate between said bands, U-shaped channels at one end of said plate remote from said handle each receiving a respective one of the bands, and a T-shaped formation at an end of said plate opposite said one end and engaged in said handle, said bands being engaged in said handle opposite said one end.

11. The handbrush defined in claim 10 wherein said bands are adhesively bonded to said plate.

12. The handbrush defined in claim 10 wherein said bands are mutually coextensive and longitudinal edges of said bands are flush with longitudinal edges of said plate.

13. The handbrush defined in claim 10 wherein said bands are multilayer webs composed of a material selected from the group consisting of rubber, synthetic resin and fabric.

14. The handbrush defined in claim 10 wherein said bristles are composed of a material selected from the group consisting of synthetic resin and metal.

15. The handbrush defined in claim 14 wherein said bristles are composed of steel.

16. The handbrush defined in claim 15 wherein said bristles are generally U-shaped with bights anchored in the respective band.

* * * * *